US009090387B2

(12) United States Patent
Hamway

(10) Patent No.: US 9,090,387 B2
(45) Date of Patent: Jul. 28, 2015

(54) DISPENSING CAP FOR ATTACHING TO A CONTAINER

(71) Applicant: Ezra Hamway, New York, NY (US)

(72) Inventor: Ezra Hamway, New York, NY (US)

( * ) Notice: Subject to any disclaimer, the term of this patent is extended or adjusted under 35 U.S.C. 154(b) by 0 days.

(21) Appl. No.: 14/219,678

(22) Filed: Mar. 19, 2014

(65) Prior Publication Data

US 2015/0144656 A1 May 28, 2015

Related U.S. Application Data

(63) Continuation-in-part of application No. 14/089,247, filed on Nov. 25, 2013.

(51) Int. Cl.
*B65D 51/28* (2006.01)
*B65D 47/20* (2006.01)

(52) U.S. Cl.
CPC ..... *B65D 51/2835* (2013.01); *B65D 47/20* (2013.01)

(58) Field of Classification Search
CPC ..... B01F 15/00831; B65D 51/2814; B65D 51/2835; B65D 81/3211; B65D 47/20
USPC ..... 206/219, 222; 215/227, 228; 222/80, 222/83, 145.5
See application file for complete search history.

(56) References Cited

U.S. PATENT DOCUMENTS

| | | | | |
|---|---|---|---|---|
| 4,515,267 | A * | 5/1985 | Welsh | 206/219 |
| 6,098,795 | A * | 8/2000 | Mollstam et al. | 206/222 |
| 6,840,373 | B2 * | 1/2005 | Gibler et al. | 206/219 |
| 7,870,952 | B2 * | 1/2011 | Fontana | 206/222 |
| 8,443,970 | B2 * | 5/2013 | Coon | 206/222 |
| 2010/0116699 | A1 * | 5/2010 | Sorenson | 206/219 |

* cited by examiner

*Primary Examiner* — Bryon Gehman
(74) *Attorney, Agent, or Firm* — Ezra Sutton, P.A.

(57) ABSTRACT

The present invention provides a dispensing cap for attaching to a container, which includes a dispensing chamber having an interior compartment for holding an ingredient to be dispensed into the container. The top end of the dispensing chamber has a flexible diaphragm and an actuator button and the lower end of the dispensing chamber is connected to a movable cone-shaped member. The dispensing chamber includes a threaded bottle cap for attaching the container to the dispensing cap. A vertical shaft includes four rectangular shaped vanes which engage and push the cone-shaped member at the bottom of the dispensing chamber. This causes the cone-shaped member to move to an open position and thereby form a dispensing opening in the bottom of the interior compartment of the dispensing chamber so that the ingredient housed within the compartment freely passes through the dispensing opening and into the container.

5 Claims, 8 Drawing Sheets

DISPENSING CAP FOR ATTACHING TO A CONTAINER

This is a continuation in part of application Ser. No. 14/089,247 filed on Nov. 25, 2013.

FIELD OF THE INVENTION

The present invention relates to a delivery system having a dispensing cap for attaching to a container. The dispensing cap includes a dispensing chamber having an interior compartment for holding the ingredient to be dispensed into the container, wherein the dispensing chamber includes a flexible diaphragm and an actuator button at the top thereof, and includes a movable cone-shaped member at the lower end.

BACKGROUND OF THE INVENTION

Dispensers are used to dispense and add powders or other ingredients, such as a liquid, to water or other solutions in a container. Typically, a dispensing chamber having an ingredient therein is attached to a bottle or container having the water or other solution therein. The dispensing chamber holds the ingredient or powder and when activated, it is is dispensed as an additive to mix with the water or solution in the container below.

Typically, the dispenser is used for sports drinks or beverages where the active ingredient, for example is an electrolyte, which is kept separate from the solution in the container until it is ready to be mixed, thus maintaining the full efficacy of the mixture.

Typical dispensers include a sealed compartment to hold the ingredient to be dispensed (the additive) which is sealed on one side of a breakable membrane. A membrane opening device is used, which is typically activated by depression of a flexible diaphragm, which causes the membrane opening device to pierce the membrane, thus enabling mixing of the contents of the dispenser with those of the container to which it is attached.

However, there are some disadvantages with current dispensers. For example, there are difficulties insuring the complete mixing of the dispensed ingredient with the solution in the container.

OBJECTS OF THE INVENTION

Therefore, it is an object of the present invention to provide a dispensing unit that may be detachably mounted on a liquid-containing bottle so the contents in the dispensing unit are completely mixed with the solution or liquid in the bottle.

It is another object of the present invention to provide a dispensing chamber which extends at least two-thirds of its length into the container or bottle below, in order to improve the effectiveness of mixing the dispensed ingredients with the solution in the container.

It is another object of the present invention to provide an enlarged dispensing chamber to hold and dispense more ingredients.

It is another object of the present invention to provide a movable cone-shaped member that moves to a fully open position in such a way so as to insure that the dispensed ingredients are completely transferred into the container below, and are completely mixed with the contents of the container.

It is another object of the present invention to provide a vertical shaft having a unique structure, which includes a combination of four (4) rectangular shaped vanes having a lower end with a v-shaped tip to provide a more effective movable shaft to engage and move the cone-shaped member.

It is another object of the present invention to provide a vertical shaft that moves downwardly in a perpendicular direction relative to the movable cone-shaped member, so that the bottom tip of the vanes at the bottom of the vertical movable shaft engage and push the cone-shaped member from a closed position to an open position.

SUMMARY OF THE INVENTION

The present invention provides a dispensing cap for attaching to a container, which includes a dispensing chamber having an interior compartment for holding an ingredient to be dispensed into the container and having a top end and a lower end, wherein the top end of the dispensing chamber has a flexible diaphragm and an actuator button concentrically disposed on the flexible diaphragm, and wherein the lower end of the dispensing chamber is connected to a movable cone-shaped member.

The dispensing chamber includes a threaded bottle cap for attaching the container to the dispensing cap, and the threaded bottle cap is concentrically disposed around the outer wall of the dispensing chamber so that at least two thirds of the length of the dispensing chamber is disposed below the threaded bottle cap and in the container.

A vertical movable shaft is also provided having a top end fixedly attached to the diaphragm and a bottom tip at the bottom end of the shaft, such that the actuator button and the movable vertical shaft are axially aligned. The shaft further includes a combination of four (4) rectangular shaped vanes having a v-shaped tip at the lower end. The movable shaft engages and pushes the cone-shaped member from a closed position to an open position to dispense the ingredient into the mixing container.

The flexible diaphragm is movable downwardly to an ingredient dispensing position by pushing the actuator button and the vertical shaft downwardly toward the center of the cone-shaped member which thereby causes the vanes at the bottom tip of the movable shaft which have a v-shaped tip to apply pressure and push the cone-shaped member to the open position for dispensing the ingredient. This causes the cone-shaped member to thereby form a dispensing opening in the bottom of the interior compartment of the dispensing chamber so that the ingredient housed within the compartment freely, easily, and fully passes through the dispensing opening into the container.

DETAILED DESCRIPTION OF THE PREFERRED EMBODIMENT

Figure 1:
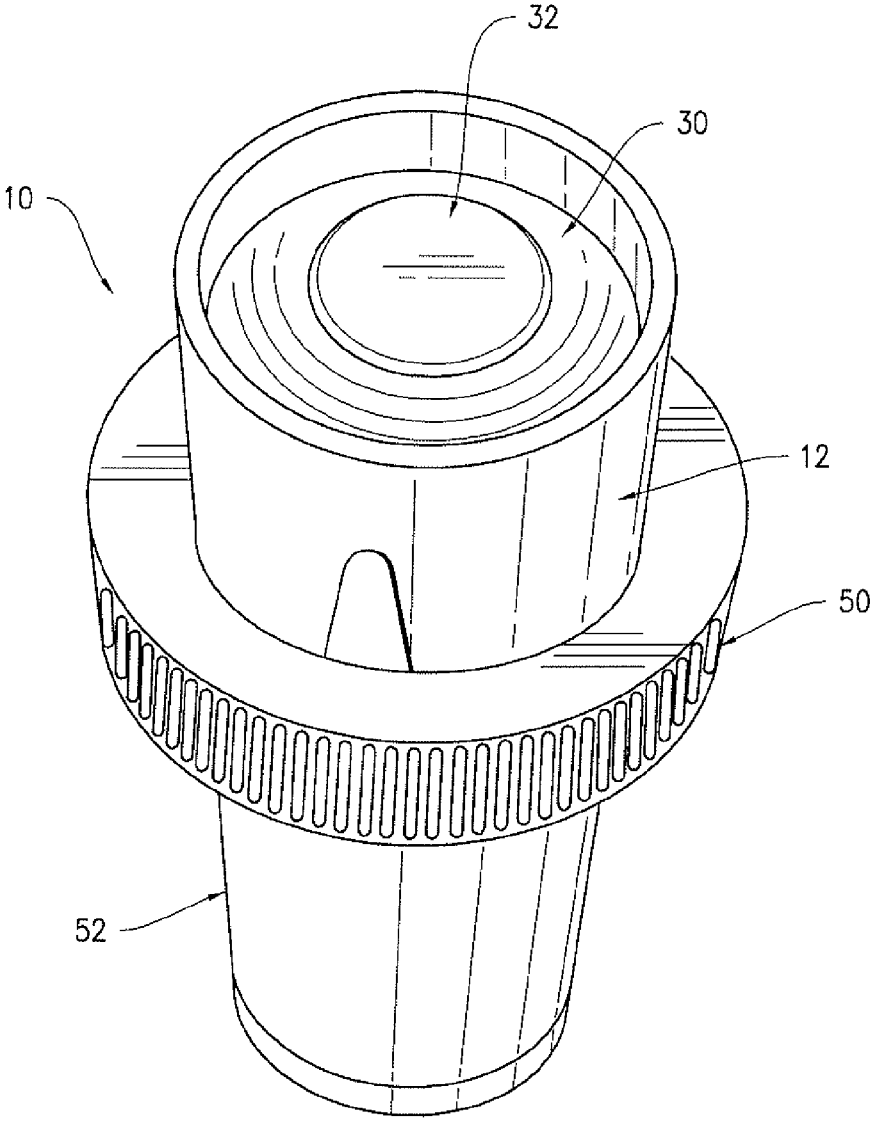
FIG. 1 is a perspective view of the front and top of the dispensing cap 10 of the present invention.
Figure 2:
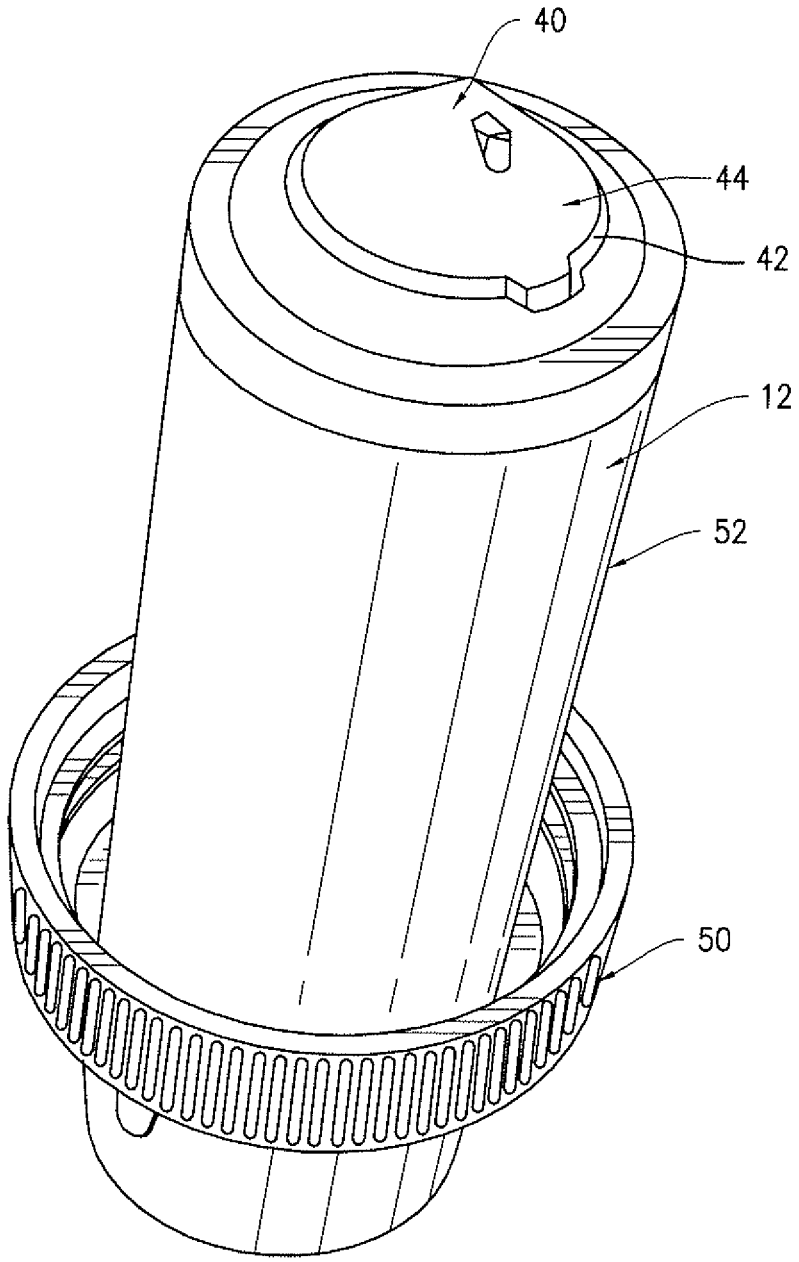
FIG. 2 is a perspective view of the front and bottom of the dispensing cap 10 of the present invention.
Figure 3:
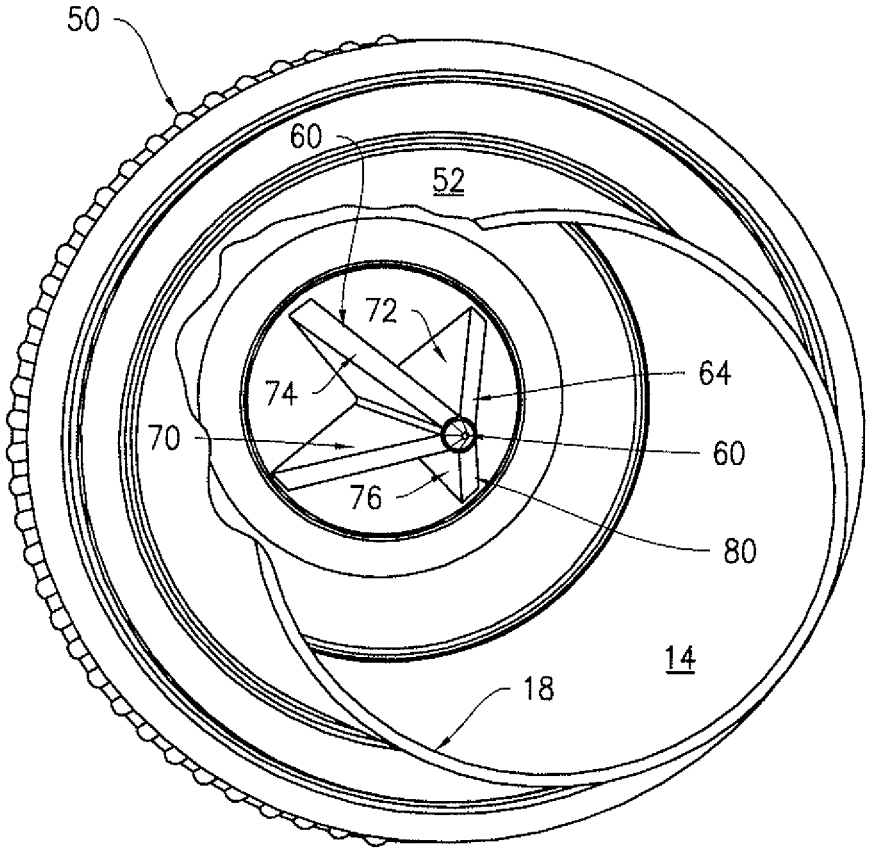
FIG. 3 is a bottom perspective view of the interior of the dispensing chamber showing the bottom of the movable vertical shaft and vanes.
Figure 4:
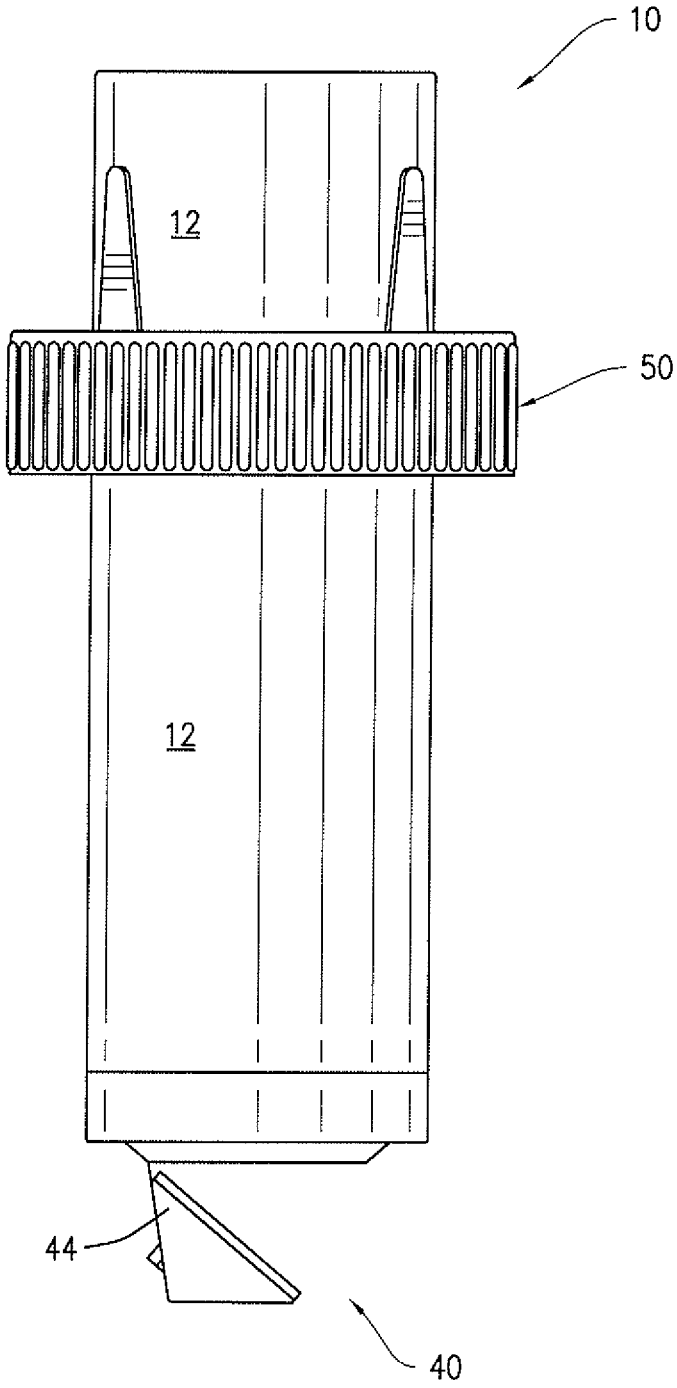
FIG. 4 is a front view of the dispensing cap 10 of the present invention showing the movable cone-shaped member in the open position to fully dispense the ingredients.
Figure 5:
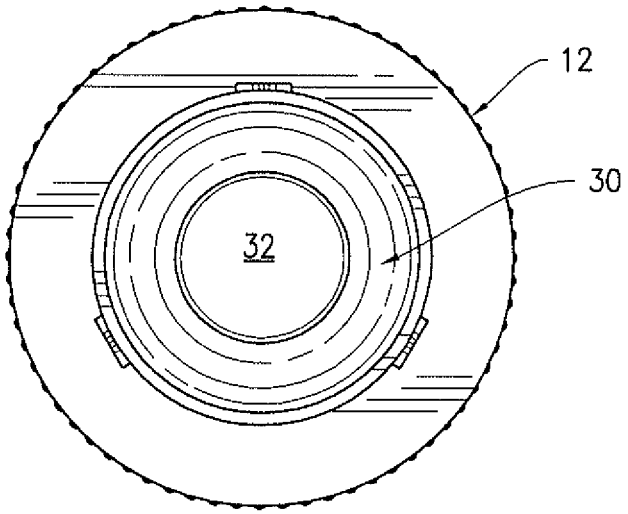
FIG. 5 is a top view of the actuator button 32 and the diaphragm 30 of the present invention.
Figure 6:
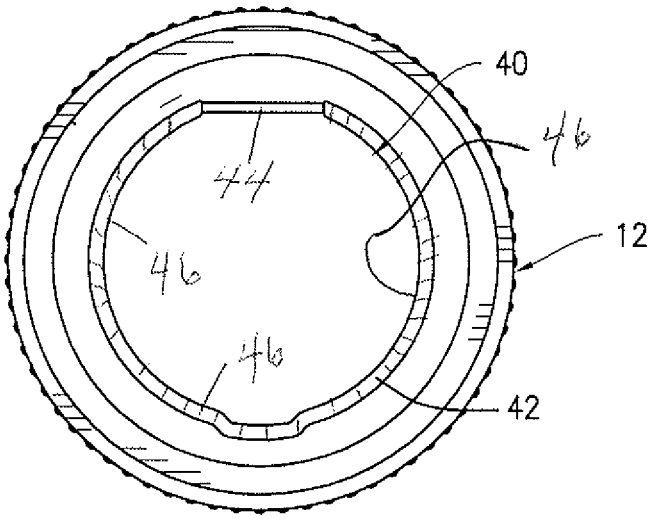
FIG. 6 is a bottom view of the movable cone-shaped member 40.
Figure 7:
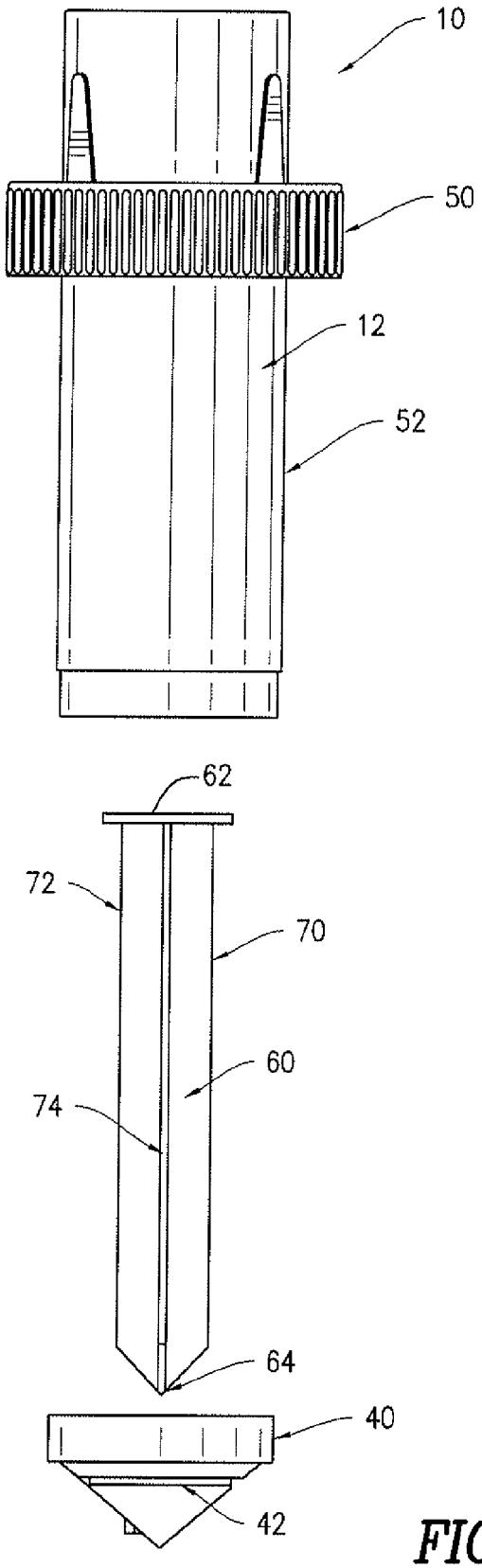
FIG. 7 is an exploded elevational view of the dispensing cap 10, the movable vertical shaft 60, and the movable cone-shaped member 40.
Figure 8:
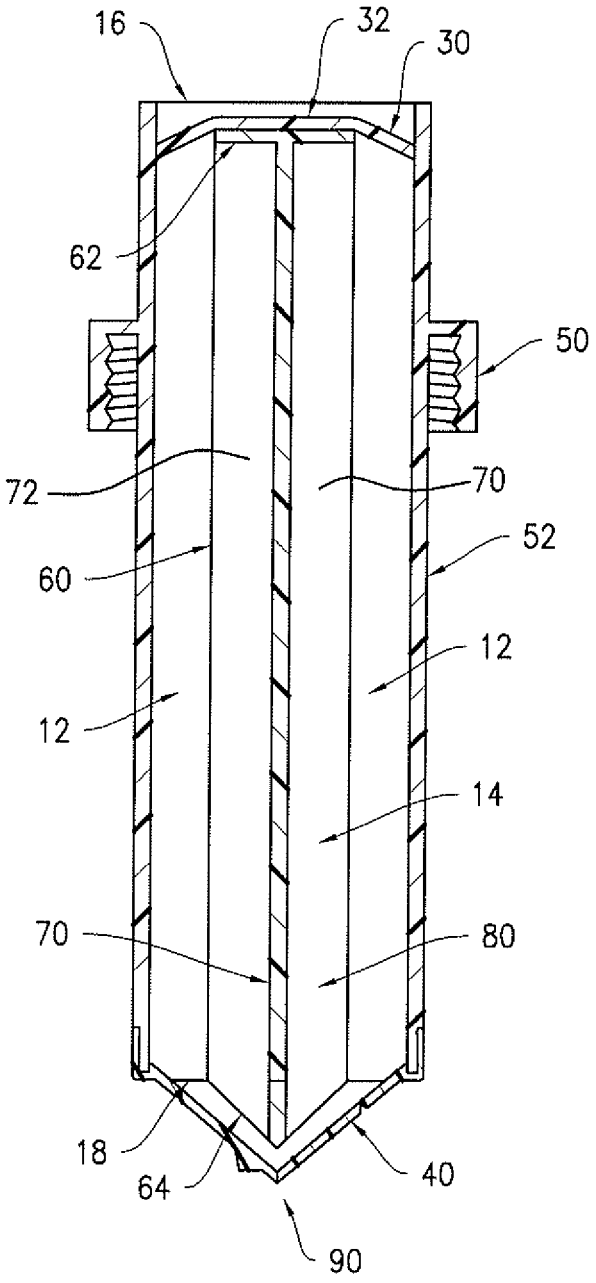
FIG. 8 is a cross-sectional view of the dispensing chamber 12, the movable shaft 60, the actuator button 32, and the cone-shaped member 40.
Figure 9:
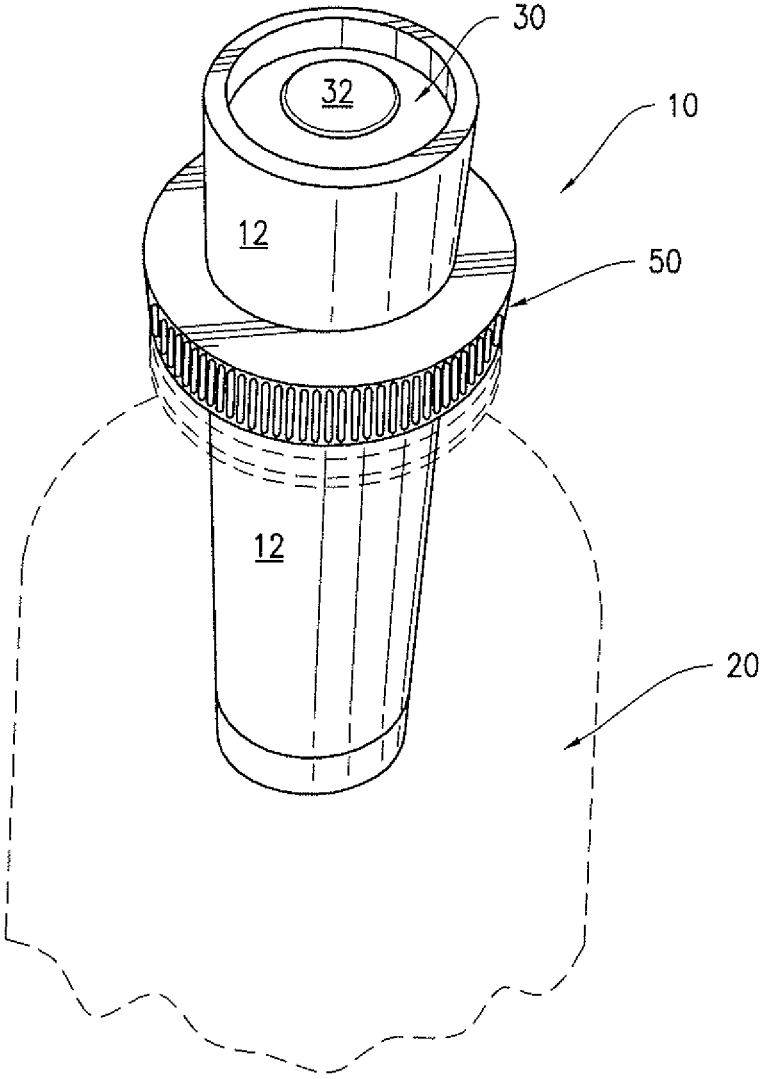
FIG. 9 is a perspective view of the dispensing cap 10 of the present invention showing it positioned on a container 20 for receiving the ingredients from the dispensing cap 10, wherein the dispensing chamber extends at least two-thirds of its length into the container.

The present invention provides a delivery system having a dispensing cap 10 for attaching to a container 20. The dispensing cap 10 includes a dispensing chamber 12 having an interior compartment 14 for holding an ingredient to be dispensed into the container 20. Dispensing cap 10 has a top end 16 and a lower end 18, wherein the top end 16 of the dispensing chamber 12 has a flexible diaphragm 30 and a center actuator button 32 concentrically disposed on the flexible diaphragm 30. The lower end 18 of the dispensing chamber 12 is connected to a movable cone-shaped member 40 that moves from a closed position to an open position.

The dispensing chamber 12 includes a threaded bottle cap 50 for attaching the dispensing cap 10 to the container 20. The threaded bottle cap 50 is concentrically disposed around the outer wall 52 of the dispensing chamber 12 so that at least two thirds of the length of the dispensing chamber 12 is disposed below the threaded bottle cap 50 and is positioned inside the container 20.

A movable vertical shaft 60 is also provided having a top end 62 fixedly attached to the diaphragm 30, and has a bottom v-shaped tip 64 at the bottom end of the movable shaft 60, such that the actuator button 32 at the top and the tip 64 at the bottom of shaft 60 are axially aligned. The shaft 60 includes four (4) rectangular shaped vanes 70, 72, 74, and 76 having the v-shaped tip 64 which engages and pushes the interior wall of the cone-shaped member 40 at a right angle from a closed position to a fully open dispensing position.

The flexible diaphragm 30 is movable downwardly to an ingredient dispensing position by pushing both the actuator button 32 and the movable shaft 60 downwardly toward the center of the cone-shaped member 40 which thereby causes the v-shaped tip 64 at the bottom tip of the shaft 60 to apply pressure at a right angle to the center of the cone-shaped member 40 to push it to an open dispensing position. This causes the cone-shaped member 40 to thereby form a dispensing opening 90 at the bottom of the interior compartment 14 of the dispensing chamber 12, so that the ingredient housed within the compartment 14 freely and completely passes through the dispensing opening 90 and into the container 20.

The interior compartment 14 of the dispensing chamber 12 extends from the top end thereof to the lower end thereof, and the actuator button 32 is concentrically disposed on the flexible diaphragm 30. In addition, the movable shaft 60, includes four (4) v-shaped vanes 70, 72, 74, and 76, which are each disposed in a perpendicular relationship relative to cone-shaped member 40. Also, each of the four (4) vanes are disposed 90 degrees apart from each other about the circumference of the movable shaft 60.

The upper peripheral edge 42 of cone-shaped member 40 has a hinge section 44 and breakable serrations 46 around the edge 42. In this manner, when downwardly movable shaft 60 engages and pushes the inner wall of cone-shaped member 40 the hinge section 44 does not break, but the serrations 46 do break around the edge 42. This allows the upper peripheral edge 42 of cone-shaped member 40 to break away from dispensing chamber 12, about the hinge 44, and allows the cone-shaped member 40 to move from its closed and sealed position, to its fully open position, in order to allow the ingredient to be fully and completely dispensed into the container below, for complete mixing of the ingredient.

OPERATION OF THE PRESENT INVENTION

In operation, the user pushes down on the actuator button 32 which moves the flexible diaphragm 30 downwardly to an ingredient dispensing position. As a result, the movable shaft 60 moves downwardly to engage the center of the cone-shaped member 40. This causes the v-shaped tip 64 at the bottom tip of the piercing shaft 60 to apply pressure at a right angle to the center of the cone-shaped member 40. This causes the cone-shaped member 40 to move to the open position and thereby forms a dispensing opening 90 in the bottom of the interior compartment 14 of the dispensing chamber 12. As a result, the ingredient housed within the compartment 14 then completely passes through the dispensing opening 90 and into the container to mix with the contents in container 20.

ADVANTAGES OF THE PRESENT INVENTION

The present invention has provided a unique dispensing cap 10 for attaching to a container 20, which includes a dispensing chamber 12 having an interior compartment 14 for holding and dispensing an ingredient, such as a powder or liquid, into the container, wherein the top of the dispensing chamber 12 has a flexible diaphragm 30 and an actuator button 32 to move the vertical shaft 60 downwardly to engage and move the cone-shaped member 40 at the lower end of the dispensing chamber 12 to the open dispensing position.

The present invention has provided the advantage of a dispensing unit that may be detachably mounted on a liquid-containing bottle so the contents in the dispensing unit are completely mixed with the solution or liquid in the bottle.

The present invention has provided the advantage of a dispensing chamber which extends at least two-thirds of its length into the container or bottle below, in order to improve the effectiveness of mixing the dispensed ingredients with the solution in the container.

The present invention has provided the advantage of an enlarged dispensing chamber to hold and dispense more ingredients.

The present invention has provided the advantage of a pivoting cone-shaped member 40 in such a way so as to insure that the dispensed ingredients are completely and fully transferred into the container below, and are completely mixed with the contents of the container.

The present invention has provided the advantage of a vertical shaft having a unique structure, which includes a combination of four (4) rectangular shaped vanes having a lower end which is v-shaped to provide a more effective movable shaft to engage and push the cone-shaped member.

The present invention has provided the advantage of a shaft that moves downwardly in a perpendicular direction relative to the cone-shaped member, so that the bottom tip of the vanes at the bottom of the shaft engage and push the cone-shaped member at a perpendicular right angle.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A delivery system having a dispensing cap for attaching to a container, said dispensing cap comprising:

(a) a dispensing chamber having an interior compartment for holding an ingredient to be dispensed into the container and having a top end and a lower end, wherein the top end of said dispensing chamber has a flexible diaphragm and an actuator button disposed on said flexible diaphragm; and wherein the lower end of said dispensing chamber is connected to a cone-shaped member;

(b) said dispensing chamber including a threaded bottle cap for attaching said dispensing cap to the container, said threaded bottle cap being disposed around the outer wall of said dispensing chamber so that at least two thirds of the length of said dispensing chamber is disposed below said threaded bottle cap, and in the container;

(c) a movable vertical shaft having a top end fixedly attached to said diaphragm and a bottom tip at the bottom end of said vertical shaft, such that said actuator button and said shaft are axially aligned, said shaft further including four substantially rectangular shaped vanes having a lower end which has a v-shaped tip which engages and pushes said cone-shaped member; and (d) said flexible diaphragm being movable downwardly from an ingredient holding position to an ingredient dispensing position by pushing both of said actuator button and said vertical shaft downwardly to engage and push said cone-shaped member which thereby causes the v-shaped tip of said movable shaft to apply pressure to said cone-shaped member, and thereby causing the entire cone-shaped member to move from a closed position to an open position, and thereby form a dispensing opening in the interior compartment of said dispensing chamber so that the ingredient held within the compartment of said dispensing chamber completely passes through said dispensing opening and into the container.

2. A dispensing cap for attaching to a container in accordance with claim 1, wherein the interior compartment of said dispensing chamber extends from the top end to the lower end thereof.

3. A dispensing cap for attaching to a container in accordance with claim 1, wherein said actuator button is concentrically disposed on said flexible diaphragm.

4. A dispensing cap for attaching to a container in accordance with claim 1, wherein said four substantially rectangular shaped vanes are disposed in a perpendicular relationship to said membrane, and are disposed 90 degrees apart from each other about said shaft.

5. A dispensing cap for attaching to a container in accordance with claim 1, wherein said cone-shaped member has a hinge on one edge and serrations on the edge to allow said serrations to break and to allow said cone-shaped member to pivot about said hinge to said open position.

* * * * *